US005080986A

United States Patent [19]

Kmiecik-Lawrynowicz et al.

[11] Patent Number: 5,080,986

[45] Date of Patent: Jan. 14, 1992

[54] MAGNETIC IMAGE CHARACTER RECOGNITION PROCESSES WITH ENCAPSULATED TONERS

[75] Inventors: Grazyna Kmiecik-Lawrynowicz, Burlington; Beng S. Ong, Mississauga, both of Canada

[73] Assignee: Xerox Corporation, Stamford, Conn.

[21] Appl. No.: 609,503

[22] Filed: Nov. 6, 1990

[51] Int. Cl.[5] ..... G03G 19/00

[52] U.S. Cl. ..... 430/39; 430/106.6

[58] Field of Search ..... 430/39, 106.6, 137

[56] References Cited

U.S. PATENT DOCUMENTS

| | | | |
|---|---|---|---|
| 4,016,099 | 4/1977 | Wellman et al. | 252/316 |
| 4,265,994 | 5/1981 | Hasegawa et al. | 430/107 |
| 4,339,518 | 7/1982 | Okamura et al. | 430/126 |
| 4,497,885 | 2/1985 | Ushiyama et al. | 430/106.6 |
| 4,517,268 | 5/1985 | Gruber et al. | 430/39 |
| 4,520,091 | 5/1985 | Kakimi et al. | 430/110 |
| 4,590,142 | 5/1986 | Yamazaki et al. | 430/138 |
| 4,599,289 | 7/1986 | Suematsu et al. | 430/98 |
| 4,614,700 | 9/1986 | Yamamoto et al. | 430/106.6 |
| 4,740,443 | 4/1988 | Nakahara et al. | 430/106.6 |
| 4,859,550 | 8/1989 | Gruber et al. | 430/39 |
| 4,965,158 | 10/1990 | Gruber et al. | 430/106.6 |
| 5,034,298 | 7/1991 | Berkes | 430/106.6 |
| 5,045,422 | 9/1991 | Kmiecik-Lawrynowicz | 430/109 |

OTHER PUBLICATIONS

CRC Handbook of Chemistry and Physics, CRC Press, Inc., Boca Raton, Florida, p. B-200, 1985.

An Introduction to the Rock-Forming Minerals; Deer, Howie, and Zussman; Longmans, Green, and Co., 1966, pp. 424–429.

*Primary Examiner*—Marion E. McCamish
*Assistant Examiner*—C. D. RoDee
*Attorney, Agent, or Firm*—E. O. Palazzo

[57] ABSTRACT

An imaging process which comprises the genertion of an image in an electronic printing magnetic image character recognition apparatus; thereafter developing the image with an encapsulated toner composition comprised of a core with a fluorocarbon-incorporated polymer binder, magnetite, and optional color pigments and a polymeric shell.

34 Claims, No Drawings

MAGNETIC IMAGE CHARACTER RECOGNITION PROCESSES WITH ENCAPSULATED TONERS

BACKGROUND OF THE INVENTION

The present invention is generally directed to encapsulated toner compositions, and imaging processes thereof. More specifically, the present invention is directed to encapsulated toners which contain fluorocarbon-incorporated core binders, including crosslinked core binders containing fluorocarbon segments, such as poly(fluoromethylene) blocks, and magnetic image character recognition imaging processes (MICR) thereof. In one embodiment, the encapsulated toners with the fluorocarbon-incorporated core binders can be selected for generating documents, such as personal checks, which can be subsequently processed in magnetic sensing reader/sorters. In an embodiment of the present invention, there are provided processes for generating documents, such as checks, including, for example, dividend checks, turn around documents such as invoice statements like those submitted to customers by American Express and VISA, corporate checks, highway tickets, rebate checks, identification badges, other documents with magnetic codes thereon, and the like, with desirable image magnetic signal strength, and no image smearing, or wherein image smearing is substantially minimized. More specifically, in one embodiment the process of the present invention is accomplished with certain encapsulated toner compositions wherein image smearing and offsetting to the read and write heads, including offsetting to the protective foil that may be present on the aforesaid heads in magnetic ink character recognition processes and apparatus inclusive of, for example, the read and write heads present in MICR (magnetic ink character recognition) reader/-sorters, such as the commercially available IBM 3890 TM, NCR 6780 TM, reader/sorters from Burroughs Corporation, and the like, is minimized or avoided. Some of the reader/sorter printers contain protective foils thereon, reference for example the IBM 3890 TM, and the problems associated with such protective foils with respect to read and write heads with no foils are substantially alleviated with the processes of the present invention. With the processes utilizing the toner and developer compositions illustrated, the problems of image smearing to and offsetting from the read and write heads in magnetic ink character recognition apparatuses is substantially eliminated. Moreover, in another embodiment the present invention is directed to improved economical processes for generating documents, such as personal checks, suitable for magnetic image character recognition wherein image smearing and offsetting, including offsetting to read and/or write heads including those with protective foils thereon, or unprotected heads is avoided when such documents are processed in the aforementioned reader/sorters. Furthermore, in another embodiment of the present invention there is provided a MICR process wherein images of high resolution are obtained with an excellent image transfer efficiency of, for example, equal to or greater than 90 percent, and in embodiments from about 95 to about 99.9 percent.

Although it is not desired to be limited by theory, image offset is eliminated or minimized with the encapsulated toners and processes of the present invention, it is believed, primarily because of the presence of the low surface energy fluorocarbon moiety in the core binder structure. Offset results from, for example, some toner materials being removed from the developed image on the MICR (magnetic ink character recognition) document, such as a check, and transferred to the read and/or write heads contained in MICR readers/sorters, such as the IBM 3890 TM and the NCR 6780 TM. As a result, toner material is removed from the MICR images on the checks, or other documents primarily in a continuous manner causing image deformation and destruction of their magnetic integrity, which would lead to rejection in most instances during the reading and sorting process. The released toner materials from the MICR images as a result of the friction between the read/sort heads and the documents may also smear onto unprinted areas within the documents. With the encapsulated toners and processes of the present invention, these problems are avoided or minimized, and more specifically the reject rate is less than one half of 1 percent for 5,000 checks processed through, for example, in the aforesaid IBM 3890 TM reader/sorter. When the aforesaid offset is eliminated or substantially reduced, the problem of image smearing onto the MICR documents, such as personal checks, is also avoided or minimized. With the processes and compositions of the present invention, in an embodiment thereof the reject rate is less than one half of 1 percent, it being noted that an acceptable reject rate usually does not exceed one half of 1 percent (0.5 percent) as determined by the American National Standards Institute (ANSI). Typically, the reject rate with the encapsulated toners and processes of the present invention is from about 0 to about 0.3 percent depending, for example, on the reader/sorter set up conditions as contrasted to a reject rate in excess of one half of 1 percent, which is usually not acceptable, with processes utilizing toner and developer compositions that contain, for example, no fluorocarbon-incorporated core binders.

With further respect to the present invention, the process is particularly applicable to the generation of documents including personal checks, which have been fused with pressure roll fusers. Pressure fixing systems, such as those incorporated in the commercial Xerox Corporation 4075 TM and the Delphax S6000 TM ionographic printers, are particularly useful with the processes of the present invention. In addition, fusing systems where heat is used, particularly in combination with pressure, for example where the above mentioned printers have been modified, are also applicable. Fuser rolls such as silicone rolls or other conformable fuser rolls, reference for example the soft fuser rolls incorporated into the Xerox Corporation 4040 TM machine, are particularly useful with the toners, developers, and processes of the present invention. Fuser roll temperatures of, for example, about 80° C. to about 165° C. are suitable for the processes of the present invention in embodiments thereof.

The documents, including the personal checks mentioned herein, can be obtained, for example, by generating a latent image thereon and subsequently developing the image, reference U.S. Pat. No. 4,517,268, the disclosure of which is totally incorporated herein by reference, with the toner and developer compositions illustrated herein. The developed image that has been created, for example, in the Xerox Corporation 9700 TM MICR printer, reference the aforesaid '268 patent, contains thereon, for example, the characters zero, 1, 2, 3, 4, 5, 6, 7, 8 and 9, and up to four symbols (E-13B and CMC-7 font), which characters are magnetically readable by the IBM 3890 TM, or other similar apparatus. One of the problems avoided with the processes of the present invention is to eliminate or reduce the offsetting of the toner as indicated herein to the read and write heads in the apparatus selected for this purpose, such as the IBM 3890 TM.

Processes for eliminating or minimizing image smearing in MICR processes are illustrated in U.S. Pat. No. 4,859,550, the disclosure of which is totally incorporated herein by reference. More specifically, there are illustrated in this patent processes for generating documents, which comprise the formation of images, such as latent images, with a printing device, especially devices generating from about 8 to about 135 prints per minute; developing the image with a single, or two component developer composition (toner plus carrier), which compositions contain, for example, resin particles, magnetite particles, low molecular weight hydrocarbons with functional groups, or polymeric alcohols; subsequently transferring the developed image to a suitable substrate; permanently affixing the image thereto; and thereafter processing the documents in reader/sorters wherein image offsetting and image smearing are avoided or substantially reduced. An example of the aforementioned process wherein a toner with no hydrocarbon, or polymeric alcohol additive is selected is illustrated in U.S. Pat. No. 4,517,268, the disclosure of which is totally incorporated herein by reference. Examples of high speed electronic printing devices disclosed in the aforementioned patent, which devices can also be utilized for the process of the present invention, include the 8700 TM and 9700 TM MICR printers available from Xerox Corporation. More specifically, there can be selected for the generation of the documents with magnetic characters thereon the Xerox Corporation 9700 TM MICR printer, about 120 prints per minute, the Xerox Corporation 8700 TM MICR printer, about 80 prints per minute, and the like. Some disadvantages associated with the polymeric alcohols and other additives of the aforementioned '550 patent, which disadvantages are avoided and/or minimized with the present invention, include objectionable odor during fusing, fuser roll contamination, and/or limited fuser roll life.

MICR processes with dry toner compositions comprised, for example, of resin particles, pigment particles, and external additives, such as fluorocarbons, such as TEFLON ® and KYNAR ®, are illustrated in U.S. Pat. No. 5,034,298 (D/89067), the disclosure of which is totally incorporated herein by reference. More specifically, there is disclosed in the aforementioned patent processes for generating documents, which comprise the formation of images, such as latent images with a printing device, including devices generating from about 8 to about 135 prints per minute; developing the image with a single or two component developer composition (toner+carrier), which compositions contain, for example, resin particles, magnetite particles, and fluorocarbon components; subsequently transferring the developed image to a suitable substrate; permanently affixing the image thereto, and thereafter processing the documents in reader/sorters wherein image offsetting and image smearing are avoided or substantially reduced. According to the aforementioned patent, there can be selected for the generation of the documents with magnetic characters thereon the Xerox Corporation 9700 TM MICR printer, about 120 prints per minute, the Xerox Corporation 8700 TM MICR printer, about 80 prints per minute, and the like. Also, there can be selected for the processes with the toners and developers of the patent other devices including ionographic printers, such as the Delphax 4060 TM printers, the Xerox Corporation 4040 TM, which contains a soft fuser roll for fixing purposes, the Xerox Corporation 4045 TM and 4050 TM. Thereafter, the formed documents with magnetic characters thereon can be processed in reader/sorter apparatuses and there results the advantages as indicated including low, and in some instances zero, reject rates. Examples of fluorocarbons disclosed in the patent include aliphatic and aromatic fluorocarbons, such as polyvinylidene fluoride, polytetrafluoroethylene, polyvinylfluoride, fully fluorinated polymeric ethylene propylene, polypentafluorostyrene, mixtures thereof, and the like, which fluorocarbons are present in various effective amounts. More specifically, the polymeric fluorocarbons are present, for example, in an amount of from about 0.1 percent to about 10 percent by weight. As internal additives, the polymeric fluorocarbons are preferably present in an amount of from about 2 percent by weight to about 10 percent by weight, while as external additives the fluorocarbons are preferably present in an amount of from about 0.3 percent by weight to about 2 percent by weight. Toner and developer compositions with the polymeric fluorocarbons present internally are formulated by initially blending the toner binder resin particles, pigment particles, and fluorocarbons, and other optional components. When the fluorocarbons are present as external additives, the toner composition is initially formulated comprised of, for example, resin particles and pigment particles; and subsequently there is added thereto the polymeric fluorocarbons. Usually, when present in the bulk of the toner or as an internal additive an effective amount of the polymeric fluorocarbon is exposed. The aforementioned fluorocarbons, which are commercially available from for example, Pennwalt Chemical Company, E. I. DuPont (TEFLON ®, KYNAR ®), Liquid Nitrogen Products Corporation, and 3M ®, possess an average particle diameter of from about 0.1 to about 5, and preferably from about 0.2 to about 1 micron, it is believed. According to the copending application, of importance with respect to the processes thereof in an embodiment thereof is the presence of the aforementioned polymeric fluorocarbons with, for example, a molecular weight average of from less than about $10^4$ and preferably from about $10^5$ to about $10^6$, and a static coefficient of friction of from about 0.04 to about 0.3. It is believed that it is these components which, in combination with the other components of the toner and/or developer, eliminate, substantially reduce or minimize toner offsetting, including offsetting to the protective foil present on the read and write heads of reader/sorters present, for example, in the IBM 3890 TM apparatus, and substantially eliminates or avoids image smearing as indicated herein.

In copending application U.S. Ser. No. 395,689 (D/89072), the disclosure of which is totally incorporated herein by reference, there are described encapsulated toners with fluorocarbon-incorporated resin binders, which binders and toners may be selected for the MICR processes of the present invention. In the aforementioned copending application, there are disclosed encapsulated toners useful for the development of xerographic images with a core containing colorants and a fluorocarbon-incorporated core resin binder, and a polymeric shell thereover. Specifically, in one embodiment there are disclosed in the copending application encapsulated toners comprised of a core containing a fluorocarbon-incorporated binder, that is wherein the fluorocarbon function is permanently attached to the core polymer binder by, for example, chemical processes, pigment or dye, and thereover a shell preferably obtained by interfacial polymerization. The aforementioned toners can be prepared by a number of different processes including the known chemical microencapsulation technique involving a shell forming interfacial polymerization and a core binder forming free radical polymerization processes; the said preparative process comprises (1) mixing or blending of a core monomer or monomers, a functionalized fluorocarbon compound, free radical initiator, pigment, and a shell monomer or monomers; (2) dispersing the resulting mixture of materials by high shear blending into stabilized microdroplets in an aqueous medium with the assistance of suitable surfactants or suspension agents; (3) thereafter subjecting the aforementioned stabilized microdroplets of a specific droplet size and size distribution to a shell forming interfacial polycondensation; and (4) subsequently forming the core binder by heat induced free radical polymerization within the newly formed microcapsules. The shell forming interfacial polycondensation is generally accomplished at ambient temperature, however, elevated temperatures may also be employed depending on the nature and functionality of the shell monomer selected. For the core binder forming free radical polymerization, heating thereof is generally effected at a temperature of from ambient temperature to about 100° C., and preferably from ambient temperature to about 85° C. In addition, more than one initiator may be utilized to enhance the polymerization conversion, and to generate the desired core copolymer binder molecular weight and molecular weight distribution. Examples of fluorocarbon reagents disclosed in the copending application include those as represented by the formula $$A-(CF_2)_x-B \quad (I)$$

where A is a structural moiety containing an addition-polymerization functionality such as an acryloxy, methacryloxy, styryl, or other vinyl function capable of undergoing addition polymerization, preferably free radical polymerization; B is a fluorine atom or a structural moiety containing an addition-polymerization functionality as described herein for A; and x is the number of difluoromethylene groups of, for example, from 1 to about 50, and preferably from about 2 to about 20. Illustrative specific examples of functionalized fluorocarbon components, or reagents disclosed in the copending application that can be utilized in an effective amount, for example in one embodiment in an amount of from about 1 percent to about 20 percent by weight of the total core binder precursors used, include the commercially available acryloxy-functionalized fluorocarbon compounds and methacryloxy-functionalized fluorocarbon compounds represented by the following Formulas (II), (III), (IV) and (V) wherein R is hydrogen or alkyl; R' is alkylene, arylene, or the derivatives thereof; and x represents the number of difluoromethylene segments, for example, x can be a number from about 1 to about 50, and preferably from about 2 to about 20:

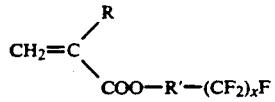
(II)

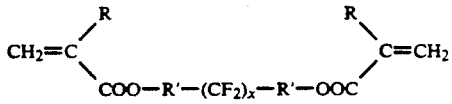
(III)

$$CH_2=CH-C_6H_5-R'-(CF_2)_x-F \quad (IV)$$

$$CH_2=CH-C_6H_5-R'-(CF_2)_x-R'-C_6H_5-CH=CH_2 \quad (V)$$

Illustrated in a U.S. Pat. No. 4,758,506, the disclosure of which is totally incorporated herein by reference, are single component cold pressure fixable toner compositions, wherein the shell selected can be prepared by an interfacial polymerization process. A similar teaching is present in abandoned patent application U.S. Ser. No. 718,676, the disclosure of which is totally incorporated herein by reference. In the aforementioned application, the core can be comprised of magnetite and a polyisobutylene of a specific molecular weight encapsulated in a polymeric shell material generated by an interfacial polymerization process.

Encapsulated and cold pressure fixable toner compositions are known. Cold pressure fixable toners have a number of advantages in comparison to toners that are fused by heat, primarily relating to the utilization of less energy since the toner compositions used can be fixed at room temperature. Cold pressure fixability also enables the machine's instant-on feature and permits the design of compact size high speed printers for space saving considerations. Nevertheless, many of the prior art cold pressure fixable toner compositions suffer from a number of deficiencies. For example, these toner compositions must usually be fixed under high pressure, which has a tendency to severely disrupt the toner's fixing characteristics. This can result in images of low resolution. The high fixing pressure can also lead to objectionable paper calendering and glossy images. With some of the prior art cold pressure toner compositions, substantial image smearing can result from the high pressures used. Additionally, a number of the cold pressure fixing toner compositions of the prior art have other disadvantages in that, for example, these compositions generate images of inferior crease and rub resistance properties, and the said images can often be readily rubbed off with pressure or removed by folding. Also, undesirable core component leaching results with a number of the prior art cold pressure fixable toner compositions, a disadvantage eliminated, or minimized with the processes and toners of the present invention.

The following prior art, all United States patents, is mentioned and was located as a result of a patentability search report for related copending application U.S. Ser. No. 395,689 (D/89072) mentioned herein: U.S. Pat. No. 4,339,518, which relates to a process of electrostatic printing with fluorinated polymer toner additives where suitable materials for the dielectric toner are thermoplastic silicone resins and fluorine containing resins having low surface energy, reference column 4, beginning at line 10, note for example the disclosure in column 4, line 16, through column 6; U.S. Pat. No. 4,016,099, which discloses methods of forming encapsulated toner particles and wherein there are selected organic polymers including homopolymers and copolymers such as vinylidene fluoride, tetrafluoroethylene, chlorotrifluoroethylene, and the like, see column 6, beginning at line 3, wherein there can be selected as the core materials polyolefins, polytetrafluoroethylene, polyethylene oxide and the like, see column 3, beginning at around line 18; U.S. Pat. No. 4,265,994 directed to pressure fixable capsule toners with polyolefins, such as polytetrafluoroethylene, see for example column 3, beginning at line 15; U.S. Pat. No. 4,497,885, which discloses a pressure fixable microcapsule toner comprising a pressure fixable component, a magnetic material, and other optional components, and wherein the core material can contain a soft material typical examples of which include polyvinylidene fluoride, polybutadiene, and the like, see column 3, beginning at line 10; U.S. Pat. No. 4,520,091 discloses an encapsulated toner with a core which comprises a colorant, a dissolving solvent, a nondissolving liquid and a polymer, and may include additives such as fluorine containing resin, see column 10, beginning at line 27; U.S. Pat. No. 4,590,142 relating to capsule toners wherein additives such as polytetrafluoroethylenes are selected as lubricating components, see column 5, beginning at line 52; U.S. Pat. No. 4,599,289 and U.S. Pat. No. 4,803,144.

With further reference to the prior art, there are disclosed in U.S. Pat. No. 4,307,169 microcapsular electrostatic marking particles containing a pressure fixable core, and an encapsulating substance comprised of a pressure rupturable shell, wherein the shell is formed by an interfacial polymerization. One shell prepared in accordance with the teachings of this patent is a polyamide obtained by interfacial polymerization. Furthermore, there is disclosed in U.S. Pat. No. 4,407,922 pressure sensitive toner compositions comprised of a blend of two immiscible polymers selected from the group consisting of certain polymers as a hard component, and polyoctyldecylvinylether-co-maleic anhydride as a soft component. Interfacial polymerization processes are also selected for the preparation of the toners of this patent.

In a patentability search report for copending application U.S. Pat. No. 5,034,298 (D/89067), there was recited the following prior art, all United States patents: U.S. Pat. No. 4,517,268, the disclosure of which is totally incorporated herein by reference, which illustrates xerography to print MICR legends, and more specifically describes a MICR process wherein the developer is comprised of a toner of magnetite and resin, and the carrier is comprised of ferrite cores; also note column 3, beginning at around line 15, wherein it is indicated that the process of the '268 patent in one embodiment involves the generation of documents including personal checks, which documents are suitable for magnetic image character recognition and wherein conventional electrostatographic methods are selected, and wherein the magnetic toner composition contains from about 20 percent by weight to about 70 percent by weight of various magnetites and 30 to 80 percent of certain toner resin particles; and also note the disclosure in column 5, beginning at line 10, wherein developer compositions are formulated; U.S. Pat. No. 4,268,598, the disclosure of which is totally incorporated herein by reference, which discloses a developer comprised of toner powder particles and a fluoroaliphatic sulfonamido surface active material, which developers may be selected for printing tickets, and the like, reference column 10 for example; also note column 7, wherein both pressure fixable and heat fusible toners may be employed, preferably conductive and magnetically attractable; U.S. Pat. No. 4,339,518, the disclosure of which is totally incorporated herein by reference, which discloses the incorporation of fluorine containing resins in a toner that will form a xerographic print that can be selected as a printing master; also note column 4, beginning at around line 16, wherein the dielectric toner contains a particular flow reading containing resin in an amount of at least 0.5 percent by weight calculated as fluorine, and that the fluorine containing resin has an excellent frictional charging property, a low surface energy, and excellent lubricating property with examples of the fluorine containing resins being outlined in column 4, beginning at around line 40, and the preparation of dielectric toner wherein the fluorine is incorporated into the toner composition is outlined in column 6, beginning at line 26; U.S. Pat. No. 4,388,396, the disclosure of which is totally incorporated herein by reference, which discloses magnetic toners with incorporated fluorocarbons as offset preventing agents; also disclosed, reference column 3, are developers including one component type developer comprising particles in which a fine powder of a magnetic substance has been incorporated therein with examples of aliphatic fluorocarbons being illustrated in column 4, beginning at around line 18, and examples of magnetites being outlined in column 9, beginning at around line 36; further, note that the fluorocarbon is incorporated into the toner, and note the disclosure beginning in column 10, line 25; U.S. Pat. No. 4,560,635 relating to magnetic toners wherein, for example, vinylidene fluoride can be selected as a resin; U.S. Pat. No. 4,590,142 relating to the use of polytetrafluoroethylene as a lubricant for magnetic toners; and as background or collateral interest U.S. Pat. No. 3,778,262; U.S. Pat. No. 3,977,871; U.S. Pat. No. 4,002,570 and U.S. Pat. No. 4,051,077.

Described in U.S. Pat. No. 4,367,275 are methods of preventing offsetting of electrostatic images of the toner composition to the fuser roll, which toner subsequently offsets to supporting substrates such as papers, wherein there are selected toner compositions containing specific external lubricants including various waxes, see column 5, lines 32 to 45, which waxes are substantially different in their properties and characteristics than the additives selected for the toner and developer compositions of the present invention; and moreover, the toner compositions of the present invention with the aforementioned fluorocarbon additives possess advantages, such as elimination of toner spotting, not achievable with the toner and developer compositions of the '275 patent.

SUMMARY OF THE INVENTION

It is a feature of the present invention to provide encapsulated toner compositions, processes for obtaining images thereof, and particularly processes for generating documents such as personal checks which are subsequently processed in reader/sorters with many of the advantages illustrated herein.

Another feature of the present invention resides in the provision of processes for generating documents, such as personal checks, suitable for magnetic ink character recognition, which processes utilize encapsulated toners with a core comprised of a polymer binder which contains a fluorocarbon function as an integral part of its structure.

In another feature of the present invention there are provided processes for generating documents, such as personal checks, suitable for magnetic ink character recognition, which processes utilize certain encapsulated toners.

Moreover, another feature of the present invention relates to processes wherein toner offsetting to the read and write heads, including those that are not protected, or those that contain a protective foil thereon is avoided.

In another feature of the present invention, there are provided processes for processing documents wherein toner offsetting and image smearing are avoided or minimized.

Also, in another feature of the present invention there are provided processes wherein, for example, image smearing and toner offsetting is avoided when documents, such as checks, containing magnetic characters (MICR) thereon are utilized in commercial sorters, and/or reader/sorters.

Additionally, in yet another feature of the present invention there are provided magnetic ink character recognition processes (MICR), which processes are suitable for the generation of documents, such as checks, with encapsulated toners with a core comprised of a fluorocarbon-incorporated polymer binder, and wherein these checks can be utilized in commercial sorters, and/or reader/sorters such as the IBM 3890 TM without toner offsetting and images smearing as illustrated herein.

Another feature of the present invention resides in the provision of encapsulated toners and MICR processes thereof wherein the toner binder is contained in the shell and leaching of the core components is avoided, or minimized.

In another feature of the present invention there are provided processes for generating documents, such as personal checks, suitable for magnetic image character recognition, and wherein these documents can be utilized in commercial sorters, such as the IBM 3890 TM and the NCR 6780 TM, without toner offsetting and image smearing as illustrated herein.

These and other features of the present invention can be accomplished by providing encapsulated toner compositions that are useful for generating documents inclusive of personal checks, which documents are subsequently processed in reader/sorter devices as illustrated herein. More specifically, the present invention is directed to processes for generating documents, which comprise the formation of images, such as magnetic images with a printing device, including devices generating from about 8 to about 135 prints per minute; developing the image with an encapsulated toner comprised of a core with a fluorocarbon-incorporated core binder as illustrated herein, and more specifically in the copending application Ser. No. 395,689 (D/89072); subsequently transferring the developed image to a suitable substrate; permanently affixing the image thereto; and thereafter processing the documents in reader/sorters wherein image offsetting and image smearing are avoided or substantially reduced. Examples of the MICR process are illustrated in U.S. Pat. No. 4,517,268, the disclosure of which is totally incorporated herein. Examples of high speed electronic printing devices disclosed in the aforementioned patent, which apparatuses can also be utilized with the encapsulated toners of the present invention, include the 8700 TM and 9700 TM MICR printer available from Xerox Corporation. More specifically, there can be selected for the generation of the documents with magnetic characters thereon the Xerox Corporation 9700 TM MICR printer, about 120 prints per minute, the Xerox Corporation 8700 TM MICR printer, about 80 prints per minute, and the like. Also, there can be selected for the processes of the present invention other devices including ionographic printers such as the Xerox Corporation 4075 TM printers, the Xerox Corporation 4040 TM, which contains a soft fuser roll for fixing purposes, and the Xerox Corporation 4045 TM and 4050 TM . Thereafter, the formed documents with magnetic characters thereon are processed in reader/sorter apparatuses as illustrated herein, and there results the advantages as indicated including low, and in some instances zero, reject rates.

One specific embodiment of the present invention is directed to MICR processes with encapsulated toners comprised of a core containing a fluorocarbon-incorporated binder, that is wherein the fluorocarbon function chemically reacts with the core binder, a magnetic material, and optional color pigments, and thereover a shell preferably obtained by interfacial polymerization.

One process for the preparation of the MICR encapsulated toner compositions of the present invention comprises (1) mixing and dispersing a core monomer or monomers, a functionalized fluorocarbon reagent, a magnetic material, a free radical initiator, optional color pigment particles or dyes, and an oil-soluble shell monomer component into microdroplets of specific droplet size and size distribution in an aqueous medium containing a surfactant or a suspension agent; the volume average microdroplet diameter can desirably be adjusted to be in the range of from about 5 microns to about 30 microns, with the volume average droplet size dispersity being less than 1.4 as determined from Coulter Counter measurements of the microcapsule particles after encapsulation; (2) forming a microcapsule shell around the microdroplets via interfacial polymerization by adding a water soluble shell forming monomer component; and (3) subsequently affecting a free radical polymerization to form a fluorocarbon-incorporated core binder within the newly formed microcapsules by, for example, heating the reaction mixture from room temperature to about 100° C. for a period of from about 0.5 to about 10 hours. Surfactants or suspension agents selected for the process include, but are not limited to, polymeric water soluble high molecular weight polymers such as poly(vinyl alcohols), methyl cellulose, hydroxypropyl cellulose, and the like. Illustrative examples of free radical initiators selected for the preparation of the toners of the present invention include azo compounds such as 2-2'-azodimethylvaleronitrile, 2-2'-azoisobutyronitrile, azobiscyclohexanenitrile, 2-methylbutyronitrile, mixtures thereof, and the like, with the quantity of initiator(s) being, for example, from about 0.5 percent to about 10 percent by weight of that of core monomer(s).

The encapsulated toners selected for the processes of the present invention are illustrated in copending application U.S. Ser. No. 395,689, the disclosure of which is totally incorporated herein by reference. Examples of selected core monomers, which are utilized in effective amounts of, for example, from about 20 to about 80 weight percent, include, but are not limited to, addition-type monomers such as methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methybutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, substituted styrenes, and other substantially equivalent addition monomers. Suitable functionalized fluorocarbon reagents that can be selected for copolymerization with the core monomers include any appropriate fluorocarbon reagents which are capable of undergoing addition polymerization with the core monomers. Examples of the fluorocarbon reagents selected for the preparation of the toner compositions of the present invention, and more specifically the fluorocarbon-incorporated core binder can be represented by the following general Formula (I):

$$A-(CF_2)_x-B \quad (I)$$

where A is a structural moiety containing an addition-polymerization functionality such as an acryloxy, methacryloxy, styryl, or other vinyl function capable of undergoing addition polymerization, preferably free radical polymerization; B is a fluorine atom or a structural moiety containing an addition-polymerization functionality as described herein for A; and x is the number of difluoromethylene groups of, for example, from 1 to about 50, and preferably from about 2 to about 20.

Specific examples of the fluorocarbon reagents that can be utilized in an effective amount of, for example in one embodiment, from about 0.1 percent to about 30 percent by weight, and preferably from about 1 percent to about 15 percent by weight of the resultant fluorocarbon-incorporated core binder composition, include the commercially available acryloxy-functionalized fluorocarbon compounds and methacryloxy-functionalized fluorocarbon compounds represented by Formula I, and the following Formula (II), (III), (IV) and (V) wherein R is hydrogen or alkyl; R' is alkylene, arylene, or the derivatives thereof; and x represents the number of difluoromethylene segments, for example x can be a number from about 1 to about 50, and preferably from about 2 to about 20:

The aforementioned fluorocarbon reagent selected can be copolymerized with an appropriate addition-type monomer as illustrated herein for the formation of the fluorocarbon-incorporated core binder of the encapsulated toner compositions of the present invention. Examples of alkyl groups present in the fluorocarbon reagents include those containing from about 1 to about 20 carbon atoms, preferably including methyl or ethyl. Examples of alkylene functions are those containing 1 to about 20 carbon atoms such as methylene, dimethylene, trimethylene, tetramethylene, 2,2-dimethyltrimethylene, 2-methyltetramethylene, and the like, with the preferred alkylene functions being methylene, dimethylene and trimethylene. Arylene examples include those with from 6 to about 24 carbon atoms such as phenylene, tolylene, 1,4-dimethylenebenzene, p-(methylenephenyl)dimethylene, and the like, with the preferred arylene being phenylene or tolylene. Both the aforementioned alkylenes and arylenes can be substituted with other substituents such as halogen, cyano, alkoxy, aryloxy functions and the like. The aforementioned functionalized fluorocarbon reagents are readily

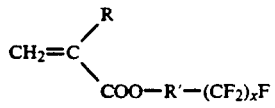
(II)

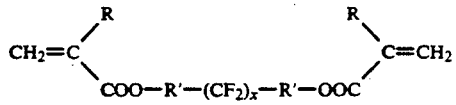
(III)

$$CH_2=CH-C_6H_5-R'-(CF_2)_x-F \quad (IV)$$

$$CH_2=CH-C_6H_5-R'-(CF_2)_x-R'-C_6H_5-CH=CH_2 \quad (V)$$

available thus, for example, acryloxy-based ZONYL TA-N TM , and methacryloxy-based ZONYL TM , are available from E. I. DuPont.

Various known magnetic materials present in the core in an effective amount of, for example, from about 15 to about 70 percent by weight of toner, and preferably in an amount of from about 25 to about 60 percent by weight can be selected inclusive of magnetites, such as Mobay magnetites MO8029 TM , MO8060 TM ; Columbian magnetites MAPICO BLACKS ®, and surface treated magnetites; Pfizer magnetites, CB4799 TM , CB5300 TM , CB5600 TM MCX6369 TM ; Bayer magnetites BAYFERROX 8600 TM , 8610 TM ; Northern Pigments magnetites NP-604 TM , NP-608 TM ; Magnox magnetites TMB-100 TM or TMB-104 TM ; and other equivalent black magnetic pigments. As optional colored pigments, there can be selected red, blue, brown, green pigments, carbon black particles, Heliogen Blue L6900, D6840, D7080, D7020, Pylam Oil Blue and Pylam Oil Yellow, Pigment Blue 1 available from Paul Uhlich & Company, Inc., Pigment Violet 1, Pigment Red 48, Lemon Chrome Yellow DCC 1026, E. D. Toluidine Red and Bon Red C available from Dominion Color Corporation, Ltd., Toronto, Ontario, Hostaperm Pink E from Hoechst, Cinquasia Magenta available from E. I. DuPont de Nemours & Company, and the like. Generally, colored pigments that can be selected include cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye indentified in the Color Index as CI 26050, CI Solvent Red 19, and the like. Illustrative examples of cyan materials that may be used as pigments include copper tetra-(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3'-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the microencapsulated toner compositions in various suitable effective amounts. In one embodiment, these colored pigment particles are present in the toner composition in an amount of from about 2 percent by weight to about 65 percent by weight calculated on the weight of the dry toner. Colored magnetites, such as mixtures of Mapico Black, and cyan components may also be used as pigments for the toners of the present invention.

Examples of shell polymers include polyureas, polyamides, polyesters, polyurethanes, mixtures thereof, and polycondensation products of polyisocyanates and polyamines as illustrated in U.S. Pat. No. 4,885,220 entitled Single Component Cold Pressure Fixable Encapsulated Toner Compositions, the disclosure of which is totally incorporated herein by reference, and the like. The shell amounts are generally present in effective amounts of, for example, from about 5 to about 30 percent by weight of the toner, and have a thickness generally, for example, of less than about 5 microns, and more specifically from about 0.1 micron to about 3 microns. Other shell polymers, shell amounts, and thicknesses can be selected.

The shell forming monomer components present in the organic phase are generally comprised of diisocyanates, diacyl chloride, bischloroformate, together with appropriate polyfunctional crosslinking agents such as triisocyanate, triacyl chloride and other polyisocyanates. Illustrative examples of the shell monomer components include benzene diisocyanate, toluene diisocyanate, diphenylmethane diisocyanate, cyclohexane diisocyanate, hexane diisocyanate, adipoyl chloride, fumaryl chloride, suberoyl chloride, succinyl chloride, phthaloyl chloride, isophthaloyl chloride, terephthaloyl chloride, ethylene glycol bischloroformate, diethylene glycol bischloroformate, and the like. The water soluble, shell forming monomer components in the aqueous phase can be a polyamine or a polyol including bisphenols. Illustrative examples of water soluble shell monomers include ethylenediamine, triethylenediamine, diaminotoluene, diaminopyridine, bis(aminopropyl)piperazine, bisphenol A, bisphenol Z, and the like. When desired, a water soluble crosslinking agent, such as triamine or triol, can also be added to improve the mechanical strength of the polymeric shell structure. Shell examples are detailed in U.S. Pat. No. 4,877,706, the disclosure of which is totally incorporated herein by reference.

Known interfacial polymerization processes can be selected for the shell formation of the toners of the present invention as illustrated, for example, in U.S. Pat. Nos. 4,000,087 and 4,307,169, the disclosures of which are totally incorporated herein by reference.

Surface additives can be selected for the toners of the present invention including, for example, metal salts, metal salts of fatty acids, colloidal silicas, mixtures thereof, and the like, which additives are usually present in an amount of from about 0.05 to about 3 and preferably about 1 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972 TM.

Also, the toner compositions of the present invention can be rendered relatively conductive with, for example, a volume resistivity of from about $10^3$ ohm-cm to about $10^8$ ohm-cm, and preferably from about $10^4$ to about $10^6$ ohm-cm, by adding to the toners thereof components such as carbon blacks, graphite, and other conductive materials in an effective amount of from, for example, about 0.1 percent to about 10 percent by weight of the toner product, and preferably from about 1 percent to about 6.5 percent by weight of toner. This level of conductivity enables especially the use of inductive development systems such as those in the commercial Delphax printer machines.

For two components developers, carrier particles including steel, iron, ferrites, copper zinc ferrites, and the like, with or without coatings, can be admixed with the encapsulated toners of the present invention, reference for example the carriers illustrated in U.S. Pat. Nos. 4,937,166; 4,935,326; 4,560,635; 4,298,672; 3,839,029; 3,847,604; 3,849,182; 3,914,181; 3,929,657 and 4,042,518, the disclosures of which are totally incorporated herein by reference.

The following examples are being submitted to further define various species of the present invention. These examples are intended to illustrate and not limit the scope of the present invention.

The remanence was measured on a tapped powder magnetite sample in a cell of 1.0 centimeter × 1.0 centimeter × about 4 centimeters. The sample was magnetized between two magnetic pole faces with a saturating magnetic field of 2,000 Gauss, such that the induced magnetic field is perpendicular to one of the 1 centimeter faces of the cell. The sample was removed from the saturating magnetic field, and the remanence is measured perpendicular to the above 1 centimeter wide face using a Hall-Effect device or a gaussmeter, such as the F. W. Bell, Inc. Model 615 gaussmeter. Coercivities were obtained from the manufacturer and were also measured on tapped powder samples using a vibrating sample magnetometer. Particle sizes were determined on dry toner samples using a Coulter Counter Model ZM, available from Coulter Electronics, Inc. Toner volume resistivity was measured on powdered samples, which were packed in a 1 $cm^3$ cell using a horeshoe magnet placed beneath the cell. Two opposite walls of the cell are comprised of 1 centimeter × 1 centimeter conductive metal plates. The other walls and the bottom of the cell are 1 centimeter × 1 centimeter, and are comprised of an insulating material. A voltage of 10 volts is applied across the plates, and the current flow through the plates is measured using an electrometer. The prepared toners were evaluated in a Delphax S6000 TM printer with the transfix pressure adjusted to 2,000 psi. Print quality was evaluated from a checkerboard print pattern. The image optical density was measured with a standard integrating densitometer. Image fix was measured by the standardized scotch tape pull method, and is expressed as a percentage of the retained image optical density after the tape test relative to the original image optical density. Image smearing was evaluated by rubbing the fused checkerboard print using a blank paper under an applied force for a specific cycle time, 10 cycles for example, and viewing the surface cleanliness of unprinted and printed areas of the page. Image ghosting was evaluated visually. For the MICR evaluation, the magnetically encoded check documents were produced using the same Delphax S6000 TM printer, unless otherwise noted. The magnetic characters were generated in accordance with the E13-B font, the standard as defined by the American National Standards Institute (ANSI). The magnetic signals from the documents were tested using the MICR-MATE I check reader obtained from Checkmate Electronics, Inc. The ANSI standards for MICR documents are believed to be 50 to 200 percent nominal magnetic signal in an E13-B font with the preferred range of about 120 to about 150 percent nominal for the MICR "On-Us" character. Tests simulating image offset, such as occurs in the IBM 3890 TM reader/sorter, which contains a protective foil on the read and write heads, were evaluated by applying a reproducible standard pressure between a protective foil and a printed image at speeds equivalent to reader/sorter operating at 2,500 checks/minute. Image offset to the protective foil as occurs in the IBM 3890 TM reader/sorter was measured either visually, or as mass of toner offset to the foil.

EXAMPLE I

A 17.1 micron (average volume diameter) conductive encapsulated toner comprising a fluorocarbon-incorporated poly(lauryl methacrylate) core binder was prepared as follows.

A mixture of 120 grams of lauryl methacrylate (available as ROCRYL 320 TM from Rohm and Haas), 13.3 grams of ZONYL TM fluorocarbon, 3.30 grams each of 2,2'-azobis-(2,4-dimethylvaleronitile) and 2,2'-azobis-(isobutyronitrile), and a solution of 47.1 grams of ISONATE 143L TM in 20 milliliters of dichloromethane was mixed in a 2 liter Nalgene container with a Brinkmann polytron equipped with a PT 35/4 probe at 4,000 rpm for 30 seconds. Two hundred and eighty (280) grams of Northern Pigments magnetite NP-608, which has a remanence of 31 Gauss, was then added, and the resulting mixture was homogenized by high sheer blending with the Brinkmann polytron at 8,000 rpm for 3 minutes. To the mixture was then added 1 liter, 0.18 percent (by weight) of aqueous poly(vinyl alcohol) (88 percent hydrolyzed; MW, molecular weight average of 96,000) solution, and thereafter, the mixture was blended at 9,000 rpm with an IKA polytron equipped with a T45/4G probe for 2 minutes. A solution of 37 milliliters of 1,4-bis-(3-aminopropyl)piperazine in 80 milliliters of water was then added with constant stirring for 10 minutes to initiate the microcapsule shell forming reaction. Subsequently, the mixture was transferred to a 3 liter reaction kettle and was mechanically stirred at room temperature for approximately 1 hour to complete the shell forming polycondensation reaction. Thereafter, the mixture was heated in an oil bath to initiate the core binder-forming free radical polymerization. The temperature of the reaction mixture was gradually increased from room temperature to a temperature of 85° C. over a period of 1 hour. Heating was continued at this temperature for an additional 6 hours before the mixture was cooled to room temperature. After the reaction, the microcapsule toner product was transferred to a 4 liter beaker, and washed repeatedly with water until the washing was clear, and the encapsulated toner product resulting was then sieved through a 180 micron sieve to remove coarse material. The wet encapsulated toner was then transferred to a 2 liter beaker and was diluted with water to a total volume of 1.8 liters. Colloidal graphite, 21.2 grams, AQUADAG E® obtained from Acheson Colloids, diluted with 100 milliliters water, was added to the beaker, and the mixture was spray dried in a Yamato Spray Dryer at an air inlet temperature of 160° C., and an air outlet temperature of 80° C. The air flow was retained at 0.75 millimeter$^3$/minute, while the atomizing air pressure was retained at 1.0 kilogram/cm$^2$. The collected encapsulated dry toner (363 grams) was screened through a 63 micron sieve; the toner's volume average particle diameter as measured on a 256 channel Coulter Counter was 17.1 microns with a volume average particle size dispersity of 1.31.

Two hundred and forty (240) grams of the above encapsulated toner was dry blended using a Greey blender, first with 0.96 gram of carbon black (BLACK PEARLS 2000®) for 2 minutes with the blending impeller operating at 3,500 rpm, and then with 3.6 grams of zinc stearate for another 6 minutes at the impeller speed of 3,000 rpm. The latter blending was continued until the volume resistivity of the prepared encapsulated toner was $1\times10^5$ ohm-cm. After dry blending, the toner was further screened through a 63 micron sieve.

The resulting toner exhibited an image fix level of 95 percent, and no image smear and no image ghosting were observed after 2,000 prints in the Delphax S6000 TM. The MICR "ON-US" character generated from this toner provided a value of 124 percent of nominal. Image offset as determined by the simulated test for 10 passes was considered to be below the detection level, that is no image offset was detectable.

EXAMPLE II

The preparation of a 15.9 micron conductive encapsulated toner with a fluorocarbon-incorporated poly(lauryl methacrylate) core binder was prepared as follows.

A mixture of 103 grams of lauryl methacrylate, 11.4 grams of ZONYL TM fluorocarbon, 2.85 grams each of 2,2'-azobis-(isobutyronitrile) and 2.85 grams of 2,2'-azobis-(2,4-dimethylvaleronitrile), and 47.1 grams of ISONATE 143 L TM was mixed by high shear blending using a Brinkmann polytron equipped with a PT 35/4 probe at 4,000 RPM for 30 seconds. To the resulting clear organic mixture was added 300 grams of Magnox magnetite TMB-100, and the resulting mixture was homogenized for 3 minutes at 8,000 RPM with the Brinkmann probe. TMB-100 has a coercivity of 92 Oersteds and a remanence of 25 Gauss. One liter of 0.12 percent aqueous poly(vinyl alcohol) solution was added, and the mixture was homogenized at 9,000 rpm for 2 minutes using an IKA polytron equipped with a T45/4G probe. To the resulting suspension was added a solution of 37 milliliters of 1,4-bis(3-aminopropyl)piperazine in 80 milliliters of water, and the resulting mixture was transferred to a 3-liter reaction kettle equipped with a mechanical stirrer and a temperature probe. The mixture was stirred at room temperature for 1 hour, and was subsequently heated in an oil bath over a period of 1 hour to a final reaction temperature of 85° C. Heating was continued at this temperature for an additional 6 hours. The reaction mixture was then worked up according to the procedure of Example I except that 18.3 grams instead of 21.2 grams of AQUADAG E® were employed during the spray-drying stage. Three hundred and fifty (350) grams of dry encapsulated toner were obtained, and the volume average particle diameter of this toner was 15.9 microns with a volume average particle size dispersity of 1.34. The toner was then dry blended to yield a final volume resistivity of $3\times10^5$ ohm-cm, and this toner was then evaluated in a Delphax S6000 printer in accordance with the procedure of Example I. The toner exhibited a fix level of 93 percent with no image smear and no image ghosting for 2,000 prints. The check documents generated using this toner provided a value of 125 percent nominal for its MICR "ON-US" character. Image offset was determined to be below the detection level, reference Example I.

EXAMPLE III

A 14.5 micron conductive encapsulated toner with a fluorocarbon-incorporated poly(lauryl methacrylate) core binder was prepared by the following procedure.

The toner was prepared in accordance with the procedure of Example I except that 108.5 grams of lauryl methacrylate, 5.7 grams of ZONYL TM, 2.85 grams each of 2,2'-azobis-(2,4-dimethylvaleronitrile) and 2,2'-azobis-(isobutyronitrile), and 300 grams of BAYFERROX 8610 TM, which has a coercivity of 150 Oersteds and a remanence of 55 Gauss, were employed in place of, respectively, 120 grams of lauryl methacrylate, 13.3 grams of ZONYL TM, 3.30 grams each of 2,2'-azobis-(2,4-dimethylvaleronitrile), 2,2'-azobis-(isobutyronitrile), and 280 grams of NP-608. In addition, 1 liter of 0.16 percent (by weight) of an aqueous solution of poly(vinyl alcohol) instead of 0.18 percent poly(vinyl alcohol) solution was selected. Three hundred and seventy-five (375) grams of dry encapsulated toner were obtained, and the toner's volume average particle diameter was 14.5 microns with a volume average particle size dispersity of 1.26. The MICR "ON-US" character generated from this toner provided a value of 145 percent of nominal. This toner was further evaluated in accordance with the procedure of Example I, and substantially similar results were obtained.

EXAMPLE IV

A 17.8 micron conductive encapsulated toner comprising a fluorocarbon-incorporated poly(lauryl acrylate) core binder was prepared as follows.

The toner was prepared in accordance with the procedure of Example I except that lauryl acrylate and ZONYL TA-N TM were utilized in place of lauryl methacrylate and ZONYL TM. In addition, 280 grams of Magnox magnetite TMB-100 were employed instead of NP-608, and the concentration of poly(vinyl alcohol) was 0.13 percent. A total of 336 grams of dry encapsulated toner product were obtained. The toner volume average particle diameter was 17.8 with a volume average particle size dispersity of 1.29. The check documents generated using this toner provided a value of 120 percent nominal for its MICR "ON-US" character. This toner was further evaluated in accordance with the procedure of Example I, and substantially similar results were obtained.

EXAMPLE V

The following example illustrates the preparation of a 13.5 micron conductive encapsulated toner comprising a fluorocarbon-incorporated poly(lauryl acrylate-stearyl acrylate) core binder.

The toner was prepared in accordance with the procedure of Example I except that 60 grams each of lauryl acrylate and stearyl acrylate were utilized in place of 120 grams of lauryl methacrylate. In addition, 0.25 percent of an aqueous poly(vinyl alcohol) solution was utilized in place 0.18 percent of aqueous poly(vinyl alcohol) solution. Three hundred and forty-seven (347) grams of encapsulated dry toner were obtained with a volume average particle diameter of 13.5 microns and a volume average particle size dispersity of 1.37. The MICR "ON-US" character generated from this toner provided a value of 125 percent of nominal. This toner was further evaluated in accordance with the procedure of Example I, and substantially similar results were obtained.

EXAMPLE VI

The following example illustrates the preparation of a 15.2 micron encapsulated toner comprising a fluorocarbon-incorporated poly(lauryl methacrylate-n-butyl methacrylate) core binder.

The toner was prepared in accordance with the procedure of Example I with 110 grams of lauryl methacrylate, 10 grams of n-butyl methacrylate, and 4.0 grams each of 2,2'-azobis-(2,4-dimethylvaleronitrile) and 2,2'-azobis-(isobutyronitrile) in place of 120 grams of lauryl methacrylate and 3.30 grams each of 2,2'-azobis-(2,4-dimethylvaleronitrile) and 2,2'-azobis-(isobutyronitrile). In addition, 280 grams of Columbian magnetite MAPICO BLACK®, which has a coercivity of 95 Oersteds and remanence of 34 Gauss, and 0.26 percent of aqueous poly(vinyl alcohol) solution were employed instead of, respectively, 280 grams of NP-608 and 0.18 percent of aqueous poly(vinyl alcohol) solution. Three hundred and forty-four (344) grams of dry encapsulated toner were obtained with a volume average particle diameter of 15.2 and a volume average particle size dispersity of 1.34. The MICR "ON-US" character image generated from this toner yielded a value 138 percent nominal. Evaluation of this toner was conducted according to the procedure of Example I, and substantially similar results were obtained.

EXAMPLE VII

A 15.7 micron encapsulated toner comprising a fluorocarbon-incorporated poly(lauryl methacrylate-stearyl methacrylate) core binder was prepared as follows.

The toner was prepared in accordance with the procedure of Example VI except that 60 grams each of lauryl methacrylate and stearyl methacrylate were employed to prepare the core binder. In addition, 280 grams of Pfizer magnetite MCX 6368 was utilized in place of MAPICO BLACK®. Three hundred and thirty-nine (339) grams of encapsulated dry toner were obtained with a volume average particle diameter of 15.7 and a volume average particle size dispersity of 1.32. The MICR "ON-US" character generated from this toner provided a value of 96 percent of nominal. Evaluation of this toner was conducted according to the procedure of Example I, and substantially similar results were obtained.

EXAMPLE VIII

A 13.7 micron conductive encapsulated toner with a fluorocarbon-incorporated poly(lauryl methacrylate-n-hexyl methacrylate) core binder is prepared by the following procedure.

The toner was prepared in accordance with the procedure of Example I except that 100 grams of lauryl methacrylate, 20 grams of hexyl methacrylate, and MAPICO BLACK® magnetite were employed instead of 120 grams of lauryl methacrylate and NP-608. In addition, 1 liter of 0.20 percent (by weight) of an aqueous solution of poly(vinyl alcohol) instead of 0.18 percent of poly(vinyl alcohol) solution was selected. Three hundred and sixty-four (364) grams of an encapsulated dry toner were obtained, and the toner's volume average particle diameter was 13.7 microns with a volume average particle size dispersity of 1.36. The MICR "ON-US" character generated from this toner provided a value of 136 percent of nominal. Evaluation of this toner was conducted according to the procedure of Example I, and substantially similar results were obtained.

Other modifications of the present invention may occur to those skilled in the art subsequent to a review of the present application. The aforementioned modifications, including equivalents thereof, are intended to be included within the scope of the present invention.

What is claimed is:

1. An imaging process which comprises the generation of an image in an electronic printing magnetic image character recognition apparatus; thereafter developing the image with an encapsulated toner composition comprised of a core comprised of the reaction product of a monomer and a fluorocarbon of the formula $$A-(CF_2)_x-B \quad (I)$$

wherein A is a structural moiety containing an addition-polymerization functionality, B is a fluorine atom or a structural moiety containing an addition polymerization functionality and x is the number of difluoromethylene groups, and is a number of from between about 1 and about 50, magnetite, and optional color pigments and a polymeric shell.

2. An imaging process in accordance with claim 1 wherein A is acylyloxy, methaclyloxy, or styryl, and B is aryloxy methaclyloxy, or styryl.

3. A process in accordance with claim 2 wherein the shell is a polyurea, a polyamide, a polyurethane, a polyester, or mixtures thereof.

4. A process in accordance with claim 2 wherein the magnetite is accicular and is present in an amount of from about 15 to about 65 percent by weight.

5. A process in accordance with claim 2 wherein the magnetite is cubic and is present in an amount of from about 40 to about 65 percent by weight.

6. A magnetic image character recognition process for generating personal checks which comprises generating images in an electronic printing device; developing the images with the encapsulated toner of claim 2; and transferring the images to a substrate; fusing the images thereto; resulting in checks with magnetic ink characters thereon.

7. A process in accordance with claim 6 which comprises feeding the resulting checks to a reader/sorter device and wherein image smearing and image offsetting to a protective foil present on the read and write head of said device is avoided.

8. A process in accordance with claim 2 wherein the fluorocarbon moiety comprises from about 0.1 mole percent to about 20 mole percent of the core binder composition.

9. A process in accordance with claim 1 wherein the encapsulated toner core is comprised of a fluorocarbon-incorporated polymer binder derived from the copolymerization of an addition-type monomer and a functionalized fluorocarbon reagent represented by the formula $$A-(CF_2)_x-B \quad (I)$$

wherein A is a structural moiety containing an addition-polymerization functional group; B is a fluorine atom or a structural moiety containing an addition-polymerization functional group; and x is the number of difluoromethylene functions; and a magnetite; and a polymeric shell; and wherein x is a number of from between about 1 to about 50.

10. A process in accordance with claim 9 wherein the addition-type monomer is an acrylate, methacrylate, or styrene monomer.

11. A process in accordance with claim 1 wherein the encapsulated toner core composition is comprised of a fluorocarbon-incorporated polymer binder derived from the copolymerization of an addition-type monomer and a functionalized fluorocarbon reagent represented by the formulas

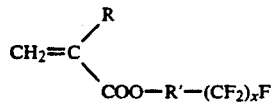
(II)

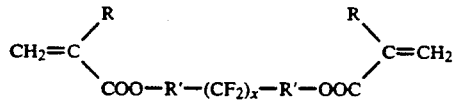
(III)

$$CH_2=CH-C_6H_5-R'-(CF_2)_x-F \quad (IV)$$

$$CH_2=CH-C_6H_5-R'-(CF_2)_x-R'-C_6H_5-CH=CH_2 \quad (V)$$

wherein R is hydrogen, or an alkyl; R' is alkylene, or arylene; and x represents the number of difluoromethylene functions, and is a number of from between about 1 to about 50.

12. A process in accordance with claim 11 wherein R is methyl or ethyl.

13. A process in accordance with claim 11 wherein R' is an alkylene group containing from 1 to about 20 carbon atoms.

14. A process in accordance with claim 11 wherein R is alkyl with from about 1 to about 20 carbon atoms.

15. A process in accordance with claim 11 wherein R and R' are substituted alkylenes and substituted arylenes.

16. A process in accordance with claim 15 wherein the substituents are halogen, cyano, alkoxy, or aryloxy.

17. A process in accordance with claim 2 wherein the core polymer binder is a copolymer derived from the copolymerization of a functionalized fluorocarbon as represented by the formulas

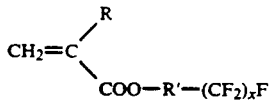
(II)

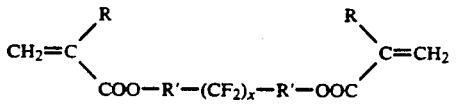
(III)

$$CH_2=CH-C_6H_5-R'-(CF_2)_x-F \quad (IV)$$

$$CH_2=CH-C_6H_5-R'-(CF_2)_x-R'-C_6H_5-CH=CH_2 \quad (V)$$

wherein R is hydrogen, or an alkyl; R' is alkylene, or arylene; and x represents the number of difluoromethylene groups, and is a number of from between about 1 and about 50 with acrylate, methacrylate, styrene monomer, or mixtures thereof.

18. A process in accordance with claim 17 wherein the monomer or monomers are selected from the group consisting of methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, substituted styrenes, or mixtures thereof.

19. A process in accordance with claim 17 wherein R is alkyl with from about 1 to about 20 carbon atoms, R' is alkylene with from 1 to about 20 carbon atoms or R' is arylene with from 6 to about 24 carbon atoms.

20. A process in accordance with claim 1 wherein the shell is prepared by interfacial polymerization.

21. A process in accordance with claim 1 wherein the shell surface contains conductive components.

22. A process in accordance with claim 21 wherein the conductive components are comprised of carbon black, graphite, or mixtures thereof.

23. A process in accordance with claim 1 wherein the magnetite is a ferromagnetic black iron oxide.

24. A process in accordance with claim 23 wherein the ferromagnetic black iron oxide is of the formula $Fe_3O_4$.

25. A process in accordance with claim 1 wherein the polymeric shell is derived from interfacial polycondensation reaction of a polyisocyanate component and a polyamine component, and wherein said polyisocyanate component is selected from the group consisting of polymethylene polyphenylisocyanates; polymethylene polyphenylisocyanates; modified diphenylmethane diisocyanates; modified diphenylmethane diisocyanates; modified toluene diisocyanates; aliphatic polyisocyanates; toluene diisocyanate, diphenylmethane diisocyanate, hexamethylene diisocyanate, trimethylhexamethylene diisocyanate, and isophorone diisocyanate; and said polyamine component selected from the group consisting of ethylenediamine, tetramethylenediamine, pentamethylenediamine, hexamethylenediamine, p-phenylenediamine, m-phenylenediamine, hydroxytrimethylenediamine, methylpentamethylenediamine, diethylenetriamine, triethylenetetraamine, tetraethylenepentaamine, diaminooctane, xylylene diamine, bis(hexamethylene)triamine, tris(2-aminoethyl)amine, 4,4'-methylenebis(cyclohexylamine), bis(3-aminopropyl)ethylenediamine, 1,3-bis(aminomethyl)cyclohexane, 1,5-diamino-2-methylpentane, piperazine, 2-methylpiperazine, 2,5-dimethylpiperazine, and 1,4-bis(3-aminopropyl)piperazine.

26. A process in accordance with claim 1 wherein the color pigments are comprised of cyan, magneta, yellow or mixtures thereof.

27. A process in accordance with claim 1 wherein the color pigments are comprised of red, green, blue, or brown.

28. A process in accordance with claim 1 wherein the core is comprised of the reaction product of lauryl methacrylate and said fluorocarbon.

29. An imaging process which comprises the generation of an image in an electronic printing magnetic image character recognition apparatus; thereafter developing the image with an encapsulated toner composition comprised of a core comprised of the reaction product of a monomer and a fluorocarbon of the formula $$A-(CF_2)_x-B \qquad (I)$$

wherein A is a structural moiety containing an addition-polymerization functionality, B is a fluorine atom or a structural moiety containing an addition polymerization functionality and x is the number of difluoromethylene groups, and is a number of from between about 1 and about 50, and magnetite, and a polymeric shell; and subsequently providing the developed image with magnetic ink characters thereon to a reader/sorter device whereby toner offsetting and image smearing is avoided or minimized in said device.

30. A magnetic ink character recognition process in accordance with claim 29 wherein the image with magnetic ink characters is formed in an ion deposition printing apparatus.

31. A process in accordance with claim 30 wherein the core polymer binder is a copolymer derived from the copolymerization of functionalized fluorocarbon reagents of the formulas

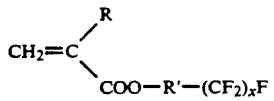

(II)

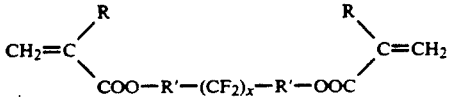

(III)

$$CH_2=CH-C_6H_5-R'-(CF_2)_x-F \qquad (IV)$$

$$CH_2=CH-C_6H_5-R'-(CF_2)_x-R'-C_6H_5-CH=CH_2 \qquad (V)$$

wherein R is hydrogen, or an alkyl; R' is alkylene, or arylene; and x represents the number of difluoromethylene groups, and is a number of from between about 1 and about 50 with methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, substituted styrenes, or mixtures thereof.

32. A process in accordance with claim 30 wherein the magnetite is a ferromagnetic black iron oxide.

33. A process in accordance with claim 29 wherein the magnetite is a ferromagnetic black iron oxide.

34. A process in accordance with claim 33 wherein the ferromagnetic black iron oxide is of the formula $Fe_3O_4$.

* * * * *